US009771670B2

(12) United States Patent
Burchert et al.

(10) Patent No.: US 9,771,670 B2
(45) Date of Patent: Sep. 26, 2017

(54) OPEN-END SPINNING DEVICE WITH AN INTERMEDIATE CHAMBER

(71) Applicant: Maschinenfabrik Rieter AG, Winterthur (CH)

(72) Inventors: Mathias Burchert, Ostfildern (DE); Josef Schermer, Bergheim-Unterstall (DE)

(73) Assignee: Maschinenfabrik Rieter AG, Winterthur (CH)

( * ) Notice: Subject to any disclaimer, the term of this patent is extended or adjusted under 35 U.S.C. 154(b) by 48 days.

(21) Appl. No.: 14/742,294

(22) Filed: Jun. 17, 2015

(65) Prior Publication Data

US 2015/0361593 A1 Dec. 17, 2015

(30) Foreign Application Priority Data

Jun. 17, 2014 (DE) ..... 10 2014 108 526

(51) Int. Cl.
*D01H 4/14* (2006.01)
*D01H 11/00* (2006.01)
*D01H 4/12* (2006.01)

(52) U.S. Cl.
CPC ..... *D01H 4/14* (2013.01); *D01H 4/12* (2013.01); *D01H 11/005* (2013.01)

(58) Field of Classification Search
CPC .. D01H 4/10; D01H 4/12; D01H 4/14; D01H 11/005
See application file for complete search history.

(56) References Cited

U.S. PATENT DOCUMENTS 2,829,286 A * 4/1958 Britz ..... H02K 5/10 310/53
3,769,785 A 11/1973 Schiltknecht
(Continued)

FOREIGN PATENT DOCUMENTS

DE 2129796 A1 12/1971
DE 2246791 A1 3/1974
(Continued)

OTHER PUBLICATIONS

German Patent Office Search Report, dated Apr. 9, 2015.

*Primary Examiner* — Shaun R Hurley
(74) *Attorney, Agent, or Firm* — Dority & Manning, P.A.

(57) ABSTRACT

An open-end spinning device of a rotor spinning machine has a spinning rotor with a rotor cup, in which fiber material is spun, and with a rotor shaft through which the spinning rotor is driven. A bearing is arranged in a contactless way with a drive to drive the spinning rotor. A rotor housing is provided in which the rotor cup is arranged and which is impinged with spinning negative pressure ($p_{SU}$) during spinning operation through a negative pressure channel. A drive housing is provided in which the rotor shaft of the spinning rotor extends, and in which the drive and the bearing of the spinning rotor are arranged. The rotor housing and the drive housing are arranged spaced apart from one another in the open-end spinning device in the axial direction of the rotor shaft. In a method to operate such an open-end spinning device, the rotor housing is impinged with spinning negative pressure ($p_{SU}$) during the spinning operation. Air current is prevented from flowing from the rotor housing into the drive housing by arranging the rotor housing and the drive housing spaced apart from one another in the axial direction of the rotor shaft.

12 Claims, 4 Drawing Sheets

(56) References Cited

U.S. PATENT DOCUMENTS

| | | | | | |
|---|---|---|---|---|---|
| 3,796,034 | A * | 3/1974 | Grau | D01H 4/10 | 57/302 |
| 3,837,154 | A * | 9/1974 | Stahlecker | D01H 4/10 | 57/302 |
| 3,934,396 | A | 1/1976 | Stahlecker et al. | | |
| 4,109,451 | A * | 8/1978 | Yamada | D01H 4/24 | 57/302 |
| 4,242,858 | A * | 1/1981 | Dschen | D01H 4/08 | 57/100 |
| 4,660,374 | A | 4/1987 | Wassenhoven | | |
| 5,709,721 | A * | 1/1998 | Stueble | B01D 46/0023 | 55/312 |
| 5,720,075 | A * | 2/1998 | Rudolf | D01H 11/005 | 15/301 |
| 5,794,430 | A * | 8/1998 | Grecksch | D01H 4/08 | 57/404 |
| 6,860,096 | B2 * | 3/2005 | Stahlecker | D01H 11/005 | 57/301 |
| 6,863,466 | B2 | 3/2005 | Bühren | | |

FOREIGN PATENT DOCUMENTS

| | | | |
|---|---|---|---|
| DE | 3527943 | A1 | 2/1987 |
| DE | 19601034 | A1 | 7/1997 |
| DE | 102012005390 | A1 | 9/2013 |
| EP | 1156142 | B1 | 4/2004 |
| EP | 2069562 | B1 | 3/2014 |
| WO | WO 2008/037325 | A1 | 4/2008 |

* cited by examiner

OPEN-END SPINNING DEVICE WITH AN INTERMEDIATE CHAMBER

FIELD OF THE INVENTION

The present invention refers to an open-end spinning device of a rotor spinning machine with a spinning rotor that has a rotor cup, in which fiber material can be spun, and a rotor shaft through which the spinning rotor can be driven, arranged in a preferably contactless bearing. Furthermore, the open-end spinning device has a drive for running the spinning rotor and a rotor housing, in which the rotor cup of the spinning rotor is arranged, impinged with spinning negative pressure during the spinning operation via a negative pressure channel of the spinning position. In addition, the open-end spinning device has a drive housing in which the rotor shaft of the spinning rotor extends and in which the drive and the bearing of the spinning rotor are arranged.

BACKGROUND

Among bearings for open-end spinning rotors, apart from the bearing in a supporting disk wedge slit, contactless bearings such as magnetic bearings and air bearings have also become known. Usually, rotors mounted in this way are electric motor driven by an individual drive. The rotor housing, which is under negative pressure during operation, is closed with a detachable lid to allow access to the rotor housing under certain situations. For example, if spinning is interrupted because a thread break or a cleaning step requires the opening of the rotor housing to perform maintenance work. Sometimes operating staff must open the rotor housing during continuous operation as well. On the other hand, the bearing and drive are arranged in a drive housing largely separated from the rotor housing, first of all to keep the volume of the rotor housing to be impinged with negative pressure small, and secondly to protect the drive and bearing of the spinning rotor from dirt (i.e. dust and fiber fly). Owing to the very high revolutions per minute of the rotating spinning rotor, it is not possible to seal the rotor housing to the drive housing completely, so that a negative pressure starts building up inside the drive housing too during the spinning operation. For example, EP 1 156 142 B1 shows an open-end spinning device with such an individually driven and magnetically mounted spinning rotor.

If the rotor housing under negative pressure of such an open-end spinning device is now opened, pressure compensation occurs, while negative pressure still prevails in the contiguous drive housing. Because of this, dirt that had accumulated in the rotor housing can now be sucked into the drive housing when the rotor housing is opened. If this dirt now reaches all the way to the individual drive of the spinning rotor and to the bearing, it can cause the failure of the bearing and drive.

EP 2 069 562 A1 therefore suggests to provide the drive housing with an additional air inlet and to supply compressed air to the drive housing before the rotor housing is opened so pressure compensation can take place there even before the rotor housing is opened. As a result of this, no dirt is sucked into when the rotor housing is opened.

SUMMARY OF THE INVENTION

A task of the present invention is to suggest an open-end spinning device in which dirt is prevented from being sucked into the drive housing, at least when the rotor housing is opened, and that can be used with different bearing types. Additional objects and advantages of the invention will be set forth in part in the following description, or may be obvious from the description, or may be learned through practice of the invention.

The objects are solved by the characteristics of the spinning device described and claimed herein.

An open-end spinning device of a rotor spinning machine has a spinning rotor with a rotor cup, in which fiber material can be spun, and a rotor shaft through which the spinning rotor can be driven, mounted on a preferably contactless bearing. Furthermore, the open-end spinning device has a drive, especially an individual drive, to drive the spinning rotor, a rotor housing, in which the rotor cup of the spinning rotor is arranged (impinged with spinning negative pressure during the spinning operation through a negative pressure channel of the spinning position), as well as a drive housing in which the rotor shaft of the spinning rotor extends and in which the drive and the bearing of the spinning rotor are arranged. The invention foresees the rotor housing and the drive housing arranged in the open-end spinning device spaced apart in the axial direction of the rotor shaft.

As part of the present invention, the rotor housing and the drive housing are understood to be merely the housing immediately surrounding the rotor or drive—formed in each case by a front and back delimiting wall and either a circumferential side wall (in the case of a cylindrical housing, for example) or several individual side walls. Here, the front delimiting wall faces the draw-off side of the spinning device and in the case of the rotor housing it is formed by a detachable lid in which the draw-off nozzle is generally arranged as well. The back delimiting wall, on the other hand, faces the drive side of the spinning device. Thus, for example, the rotor housing and/or the drive housing can also be connected to one another via a spacer that ensures the separated arrangement of the rotor housing and drive housing. Such a spacer can also be formed as one part on the rotor housing and/or drive housing.

In a method for operating an open-end spinning device of a rotor spinning machine, in which the open-end spinning device is driven by a drive, especially an individual drive arranged in a bearing, preferably contact-less arranged spinning rotor with a rotor cup and rotor shaft, and in which the rotor cup of the spinning rotor is arranged in a rotor housing, the rotor housing is impinged with spinning negative pressure during the spinning operation. Here, the rotor shaft of the spinning rotor extends in a drive housing, in which furthermore the drive and bearing of the spinning rotor are also arranged. The method prevents an air current from the rotor housing to the drive housing by arranging the rotor housing and the drive housing at equal distances from one another in an axial direction of the rotor shaft in the open-spinning device.

Owing to the spaced-apart arrangement of the rotor housing and the drive housing, surrounding air pressure prevails both during the spinning operation and when the rotor housing is opened in the area contiguous to the rotor housing and the drive housing that is not sealed to the exterior surroundings. Thus, no negative pressure can build up in the drive housing during the spinning operation. Therefore, when the rotor housing is opened and pressure compensation takes place in it, dirt particles can no longer be sucked into the drive housing.

According to an advantageous further development of the invention, an intermediate chamber has been arranged between the rotor housing and the drive housing, and this intermediate chamber has a first connecting opening to the rotor housing and a second connecting opening to the drive housing. Moreover, the intermediate chamber has a third opening through which the intermediate chamber is connected either to a negative pressure source or to surrounding air pressure, at least when the spinning operation is interrupted.

In the method used to operate the open-end spinning device, an intermediate chamber has been arranged between the rotor housing and the drive housing, connected to the rotor housing through a first connecting opening and to the drive housing through a second connecting opening. Here, the shaft of the spinning rotor extends from the rotor housing to the drive housing. The method provides the intermediate chamber to be impinged (at least when the spinning operation is interrupted) in such a way with negative pressure or surrounding air pressure that when the rotor housing is opened, an air current is at least prevented from flowing into the drive housing. Preferably, an air current from the drive housing to the intermediate chamber is generated in the method.

Thus, the intermediate chamber is impinged at least simultaneously with negative pressure or surrounding air pressure as soon as the rotor housing starts to be opened, but preferably already shortly before that. While this occurs, the intermediate chamber remains at least impinged as long as the interruption of the spinning process lasts or as long as the rotor housing is opened. However, it is also possible to impinge the intermediate chamber constantly, i.e. during the spinning operation as well. Therefore, the arrangement of the intermediate chamber between the rotor housing and the drive housing makes it possible to prevent, or at least largely prevent, an air current of dirty air to be sucked into the drive housing by the selective impingement of the intermediate chamber. In particular, the impingement of the intermediate chamber with negative pressure can also generate a selective air current through the intermediate chamber that not only counteracts a sucking in of dirt particles into the drive housing when the rotor housing is opened, but can also prevent deposits during the operation.

Here, the intermediate chamber can be executed as a separate housing or as extension of the rotor housing or drive housing or of both. For example, the side wall(s) of the rotor housing can be extended beyond its back delimiting wall and form the intermediate chamber as a result of that. The intermediate chamber formed in this way is sealed from the adjoining drive housing by means of a seal. Analogously, the side wall(s) of the drive housing could also be extended beyond its front delimitation wall.

Here, the first and/or second connecting opening is/are preferably arranged around the rotor shaft. In particular, the first and/or second connecting opening is/are executed as ring gap around the rotor shaft, as it is not possible to fully seal the housings against one another most of the time. However, it is also possible to place the connecting openings, especially the first connecting opening to the rotor housing, in the area of a collar of a rotor cup. The first connecting opening, in particular, can therefore also be executed as ring gap around the rotor disk collar. It is thus possible, on the one hand, to achieve a certain sealing of the housings or intermediate chamber to one another (which especially allows maintaining the spinning negative pressures in the rotor housing) and nonetheless create a selective air current through the ring gaps that transports dirt away. If the first connecting opening is provided in the area of the rotor cup collar, then it is possible—at least in one intermediate chamber impinged with negative pressure—to advantageously suck possible dirt out of the coupling location between rotor shaft and rotor cup when the latter is disassembled.

It is furthermore advantageous if the bearing comprises an axial bearing facing away from the rotor cup that acts on the end of the spinning rotor. This takes over the axial bearing of the spinning rotor, so that the radial bearing of the spinning rotor can be executed independently of it. As a result of this, the execution and control of the radial bearing are simplified and the bearing is less vulnerable compared to an execution in which no separate axial bearing is provided.

It is especially advantageous if the axial bearing is executed as axial air bearing or comprises at least an axial air bearing, because this design can support the creation of an air current from the drive housing into the intermediate chamber. However, the invention can also be used in an open-end spinning device in which the axial bearing of the spinning rotor is also executed as a magnetic bearing or in another way too.

It is additionally advantageous if the bearing comprises a magnetic bearing, especially a radial magnetic bearing. Especially in an individually driven spinning rotor, the execution of the radial bearing of the open-end spinning rotor as a magnetic bearing is advantageous. Since such magnetic bearings are very prone to become dirty, the advantageous design that includes a selective air current with the help of an intermediate chamber between the rotor housing and the drive housing is very effective there.

According to an advantageous first embodiment of the invention, the intermediate chamber is impinged with negative pressure, at least when the rotor housing is opened, preferably even before the rotor housing is opened. To achieve this, the intermediate chamber has—apart from the two connecting openings executed as a ring gap—a third opening connected to a negative pressure source. When the rotor housing is now opened, there is pressure equalization with the surroundings in the rotor housing, and then as a result of the negative pressure prevailing in the intermediate chamber and ring gap area between the intermediate chamber and the drive housing, dirt is prevented from being sucked into the drive housing. The special advantage of this design is that there is also negative pressure in the area of the connecting opening from the intermediate chamber to the rotor housing, so that any deposits from the area behind the rotor cup can be sucked out and immediately transported away. If at least the axial bearing of the spinning rotor, possibly also the radial bearing, is executed here as an air bearing, then the air current through the intermediate chamber can be furthermore supported as a result of this.

It is very advantageous here if the intermediate chamber is constantly impinged with negative pressure, also during the spinning operation, because this makes it possible to prevent the deposit and movement of impurities already during the spinning operation.

In an extremely advantageous embodiment, both the intermediate chamber and the rotor housing are impinged with spinning negative pressure. To achieve this, the intermediate chamber is directly connected to the negative pressure channel of the open-end spinning device via the third opening for the spinning negative pressure. Thus, with the exception of providing an intermediate chamber, no more constructive measures need to be implemented, thus allowing the open-end spinning device to be made economically too. In this case, the intermediate chamber can be connected to the negative pressure channel, which also connects the rotor housing with the negative pressure source or a machine-long negative pressure line, or they can have their own negative pressure channel to the negative pressure source or to the machine-long negative pressure line. Another advantage of this embodiment is that an air current from the intermediate chamber to the negative pressure channel is generated at least when the rotor housing is opened, and the current ensures not only that air is prevented from being sucked into the drive housing but also that air is actively transported away from the drive housing.

However, according to a variation of this embodiment, it is not necessary to impinge the intermediate chamber with negative pressure all the time. Rather, it is sufficient to do this just before or also only until the rotor housing is opened. In this case, the third opening of the intermediate chamber can be provided with a controllable shut-off device that can be activated preferably by the opening and closing of the rotor housing. Thus, for example, the opening of the rotor housing or of a swivel housing linked to the rotor housing can be registered by a sensor, which in turn triggers the activation of the shut-off device. Needless to say, a purely mechanical coupling of the shut-off device with the rotor housing is also possible.

On the other hand, according to another embodiment, the third opening is not connected to a negative pressure source but merely connected to the surrounding air. Here, the intermediate chamber is constantly impinged with surrounding air pressure via the third opening or is connected to the surrounding pressure. In this case, the forming of a negative pressure in the drive housing during the spinning operation is prevented due to the surrounding air pressure in the intermediate chamber. Therefore, when the rotor housing is opened too, no air is sucked into the drive housing. This embodiment can also be used both with a magnet bearing and with an air bearing or with a combined bearing. In this context, it is also possible to supply only small air doses through the third opening of the intermediate chamber that are just enough to prevent dust from being sucked in from the rotor housing into the intermediate chamber or drive housing. Furthermore, as a result of this, a very small amount of air can be supplied to the rotor housing to prevent from the outset deposits in the rotor housing behind the rotor disk. Thus, no impurities can reach the drive housing any longer even if the rotor housing is opened because of the pressure increase occurring there. Here, the amount of the supplied air can be regulated through the size of the third opening. In this case, a pressure occurs in the intermediate chamber and (owing to the connecting opening to the drive housing) in the drive housing also, which although being higher than the spinning negative pressure in the rotor housing, is still below the surrounding air pressure (due to the small amount of air supplied).

It is furthermore advantageous if the surrounding air is filtered before supplying it to the intermediate chamber. For this purpose, the third opening is preferably provided with an air filter in an open-end spinning device. Filtering the air being supplied to the intermediate chamber can therefore prevent dirt from penetrating the rotor housing from the surroundings.

If the bearing of the spinning rotor has an air bearing, then it is advantageous for implementing the method if the air throughput is controlled by the air bearing in such a way that a larger pressure will always prevail in the drive housing than in the intermediate chamber. As a result of this, air and dirt can be prevented not only from being sucked into an intermediate chamber impinged with negative pressure or surrounding air pressure when the rotor housing is opened, but at the same time impurities are prevented from penetrating the drive housing during the spinning operation. Such impurities can also form during normal spinning operation without dirty air being actively sucked in owing to the insufficient sealing of the ring gap area.

BRIEF DESCRIPTION OF THE DRAWINGS

More advantages of the invention are described by means of the embodiments described below, which show.

DETAILED DESCRIPTION

Figure 1:
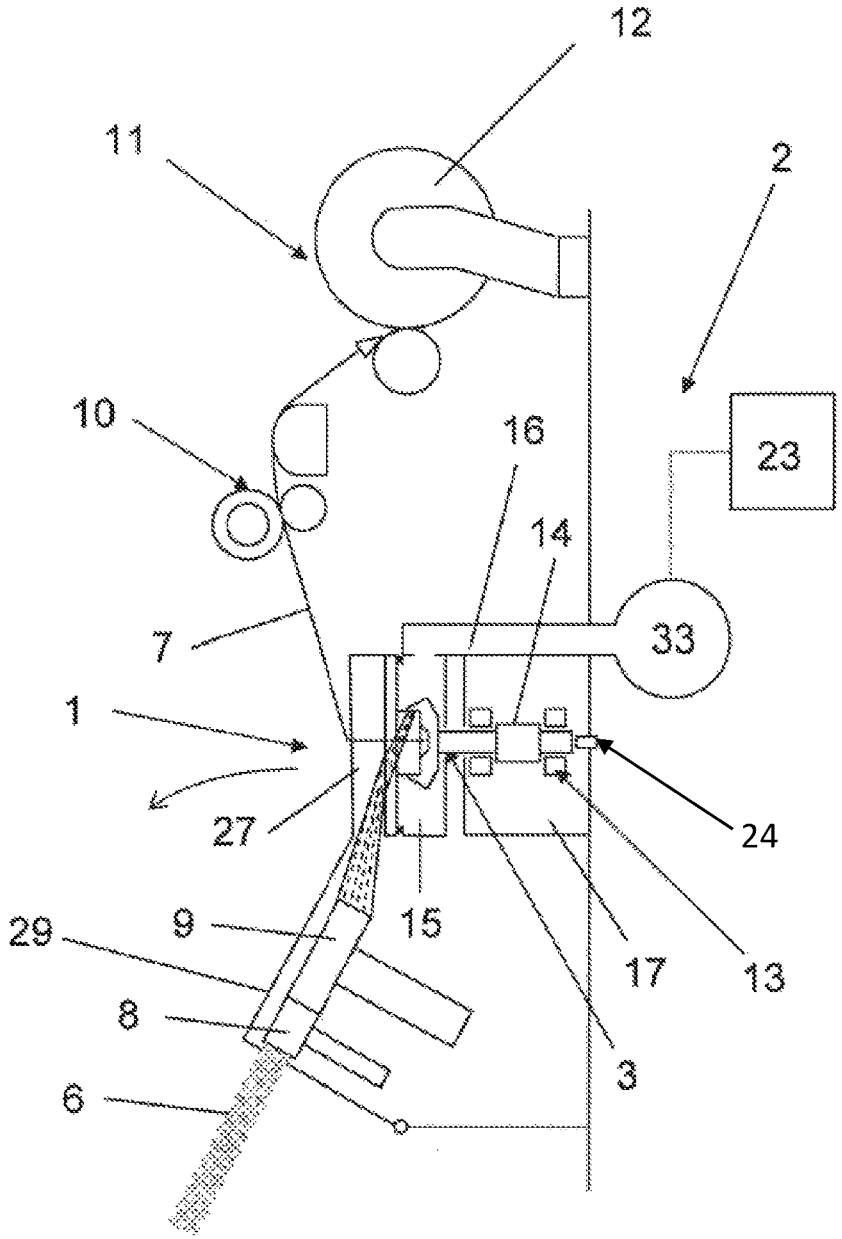
FIG. 1 a side view of an open-end spinning device of a rotor spinning machine in a schematic overview.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of an open-end spinning device 1 of a rotor spinning machine 2. The rotor spinning machine 2 usually comprises a feeding device 8, which supplies fiber material 6 to the open-end spinning device 1 through an opening device 9 that opens the fiber material into individual fibers. In the open-end spinning device 1, the fiber material 6 is spun to yarn 7 in a rotor cup 4 (see FIGS. 2-6) of a spinning rotor 3, drawn off through a draw-off device 10 and wound on a bobbin 12 with a winding device 11.

Apart from the spinning rotor 3 with the rotor cup 4 and rotor shaft 5 (see FIGS. 2-6), the open-end spinning device 1 comprises a rotor housing 15, in which the rotor cup 4 is arranged, and a drive housing 17, in which the shaft 5 of the spinning rotor 3 extends. According to this description, the spinning rotor 3 is driven by means of an individual drive 14 and arranged in a bearing 13. Here, support disk bearings, magnetic bearings and air bearings are considered as a bearing 13 of the spinning rotor. In this case, the bearing 13 comprises radial bearings 25 and can additionally also comprise an axial bearing 24 executed separately from the radial bearings 25. The axial bearing 24 can be executed as an axial air bearing **24*a* or as an axial magnetic bearing or also be formed by a combination of these two bearing types. Another type of bearing different from the bearing types shown can be used alternatively or additionally in the open-end spinning machines 1 of FIGS. 2-6. For reasons of clarity, only the bearing 13** is labeled without its individual components here.

The rotor housing 15 is closed by means of a detachable lid 27, especially one that can be swiveled (see arrow). To perform maintenance work on the open-end spinning device, the lid 27 of the rotor housing 15 can be removed either by an automatic maintenance mechanism or an operator, as symbolized here by an arrow. According to this drawing, the lid 27 of the rotor housing 15 is connected to a swivel housing 29 that can be swiveled out and opened together with it. However, it is also possible to provide the rotor housing 15 with a separate lid 27. During the spinning operation, the rotor housing 15 is impinged with the spinning negative pressure $p_{SU}$ required for the spinning process by means of a negative pressure channel 16 of the open-end spinning device 1. To do this, the negative pressure channel 16 of the open-end spinning device 1 is connected here to a machine-long negative pressure line 33 which, in turn, is connected to a central negative pressure source 23. To maintain the spinning negative pressure $p_{SU}$ in the rotor housing 15, a seal 28 has been placed between the lid 27 of the rotor housing 15 and the rotor housing 15.

On the other hand, the drive 14 and the bearing 13, which act together with the rotor shaft 5 of the spinning rotor 3, are arranged in a drive housing 17 separated from the rotor housing 15 in order to protect it from impurities coming from the surroundings and also from fiber fly and impurities coming from the spinning rotor 3 area. Thus, the rotor shaft 5 of the spinning rotor 3 extends from the rotor housing 15 to the drive housing 17.

Owing to the high revolutions per minute of the spinning rotor 3, it is not possible to fully seal the rotor housing 15 from the drive housing 17. In conventional spinning devices, this also leads to the build-up of negative pressure in the drive housing 17 as well during the spinning operation, which then in turn causes air and impurities to be sucked into the drive housing 17 from the rotor housing 15 area when the rotor housing 15 is opened. To prevent this, according to FIG. 1, the rotor housing 15 and the drive housing 17 are arranged spaced-apart from one another in the axial direction of the rotor shaft 5 in the open-end spinning device 1. The drive housing 17 is now no longer directly connected to the rotor housing 15 but merely to an area of the open-end spinning device 1 not sealed from the surrounding air pressure $p_U$. Thus, no negative pressure builds up in the drive housing 17 during the spinning operation, so that no impurities can be sucked any longer into the drive housing 17 even when the rotor housing 15 is opened. In this case, it is advantageous if the two housings 15 and 17 are separated from one another by at least 3 mm, preferably by at least 5 mm, very preferably by at least 10 mm, to securely prevent the effects that the negative pressure prevailing in the rotor housing 15 will have on the drive housing 17. According to an advantageous further development, an intermediate chamber 18 is provided between the rotor housing 15 and the drive housing 17 arranged at a distance from it. Such an open-end spinning device 1 with the rotor housing 15 and the drive housing 17 will be described in more detail below with the help of FIGS. 2-6, which show a detailed view of various embodiments of an open-end spinning device 1.

FIG. 2 shows once again the rotor 3 with the rotor cup 4 and the rotor shaft 5. Furthermore, a draw-off nozzle 34 arranged in the lid 27 of the rotor housing 15 can be seen, through which the yarn 7 produced in the rotor cup 4 is drawn off. In the area of the drive housing 17, both the individual drive 14 and the bearing 13 can now be recognized in detail. In this case, two radial bearings 25 executed as magnetic bearings **25*a* are provided. Furthermore, an axial bearing 24 is provided that can comprise an axial magnetic bearing or an axial air bearing 24*a* or an axial bearing 24 combined from both types of bearing. Here, an axial air bearing 24*a* fed by a pressurized air source 31 is shown that acts on an end of the spinning rotor 3 facing away from the rotor cup 4**.

Figure 2:
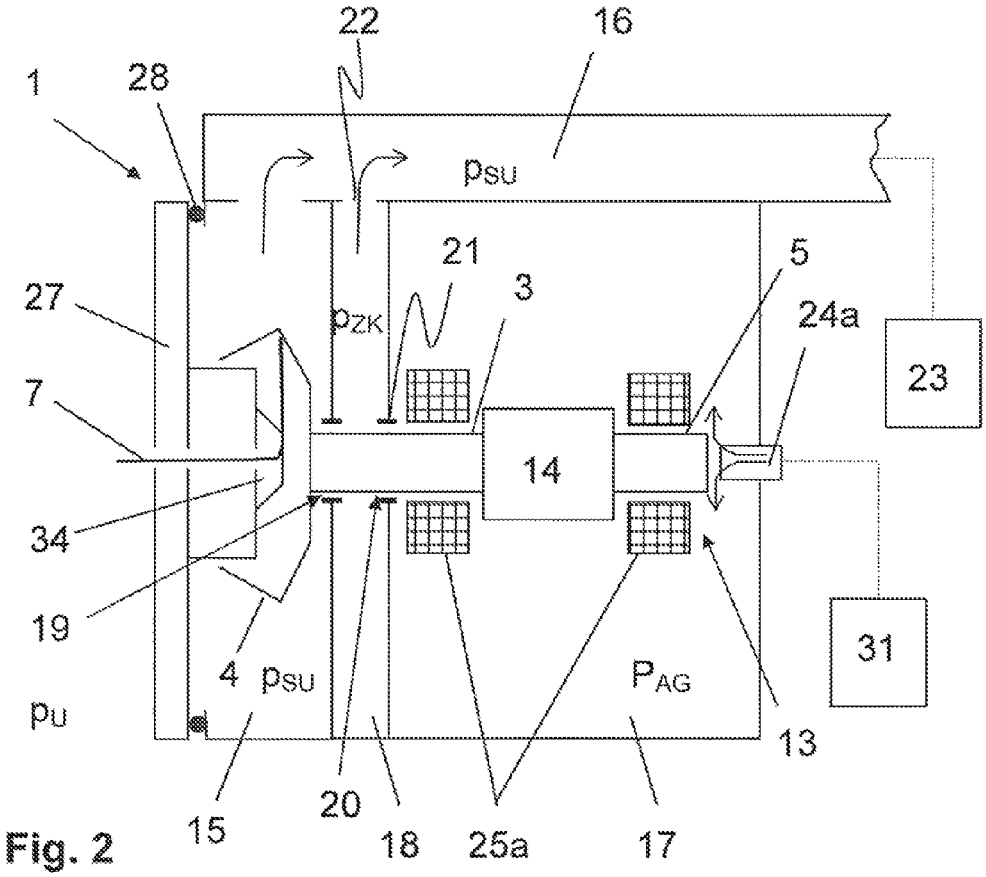
FIG. 2 a first embodiment of an open-end spinning device with an intermediate chamber connected to a negative pressure source.

Furthermore, it can be seen in FIG. 2 that, in spite of the arrangement of ring seals 21, a ring gap remains in each case between the contiguous housings or chambers. To prevent air of the rotor housing 15 area from being sucked into the drive housing 17 when the rotor housing 15 is opened, an intermediate chamber 18 has therefore been arranged between the rotor housing 15 and the drive housing 17. The intermediate chamber 18 is connected to the rotor housing via a connecting opening 19 and to the drive housing 17 via a second connecting opening 20. To keep the size of the connecting openings 19 and 20 as small as possible, a ring seal 21 is provided in each case in the area of the two ring gaps.

According to the embodiment of an open-end spinning device shown in FIG. 2, the intermediate chamber 18 has a third opening 22 that is in constant contact with a negative pressure source 23. For example, the intermediate chamber 18 can be in contact with the negative pressure source 23 for the spinning negative pressure $p_{SU}$ through the machine-long negative pressure line 33. Here, the intermediate chamber 18 is also connected to the negative pressure channel 16 for this.

Thus, during the spinning operation, spinning negative pressure $p_{SU}$ prevails in the rotor housing 15, while a pressure $P_{AG\ sets}$ in inside the drive housing 17 owing to the axial bearing 24 executed as air bearing **24*a* that exceeds the spinning negative pressure $p_{SU}$. However, due to the very small amount of air passing through the air bearing 24*a* compared to the amount of air passing through the negative pressure channel 16, the air pressure $P_{AG}$ always remains lower than the surrounding air pressure $P_U$ that surrounds the spinning device 1, even during the spinning operation. As a result of this, an air pressure $P_{ZK}$ sets in inside the intermediate chamber 18 that is also lower than the surrounding air pressure $P_U$ and lies between the spinning negative pressure $P_{SU}$ and the air pressure of the drive housing $P_{AG}$. Thus, during the spinning operation, an air current is generated from the drive housing to the intermediate chamber that advantageously prevents impurities from penetrating the drive housing 17** already during the spinning operation.

When the rotor housing 15 is opened, however, pressure is now equalized in the rotor housing 15 to that of the surrounding air pressure $P_U$. Any impurities from the rotor housing 15 are now, however, merely sucked into the intermediate chamber 18 owing to the negative pressure $P_{ZK}$ adjacent to the intermediate chamber and transported out to the negative pressure channel 16 through the third opening 22. The penetration of impurities from the rotor housing 15 into the drive housing 17 can thus be prevented both during the spinning operation and when the rotor housing 15 is opened.

Figure 3:
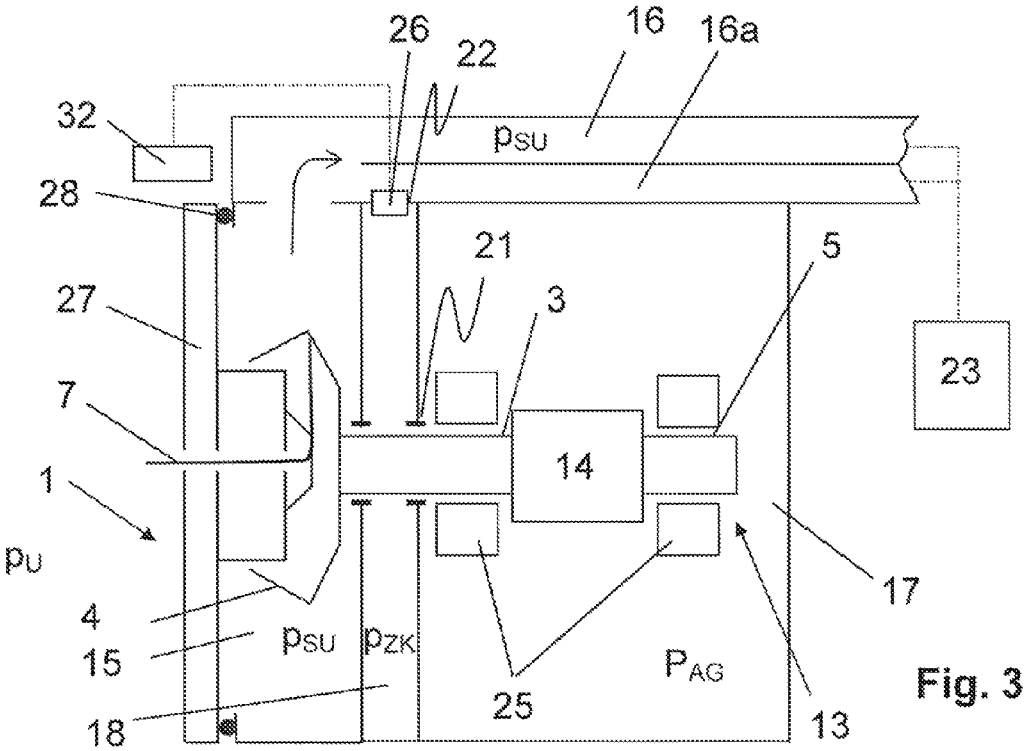
FIG. 3 a variation of the open-end spinning device shown in FIG. 2 with an intermediate chamber impinged with negative pressure.

The effect described can be improved even more if, similarly to FIG. 3, the intermediate chamber 18 is connected to the machine-long negative pressure line 33 or another negative pressure source 23 via a separate negative pressure channel **16*a*. Due to the sudden pressure compensation in the rotor housing 15 to the surrounding air pressure $P_U$ when the rotor housing 15 is opened, the pressure can also equalize in the negative pressure channel 16, so that the intermediate chamber 18 can now no longer be sufficiently impinged with negative pressure. By connecting the intermediate chamber 18 by means of its own negative pressure channel 16***a*, the negative pressure (air pressure $P_{ZK}$) in the intermediate chamber 18 can still be maintained after opening the rotor housing 15. Alternately to an own negative pressure channel 16*a* for the intermediate chamber 18, it is also possible to arrange the third opening 22 or the connection of the intermediate chamber 18 to the negative pressure channel 16 near the machine-long negative pressure line 33 or connect the intermediate chamber 18 directly to the machine-long negative pressure line 33. Owing to the spatial proximity to the machine-long negative pressure line 33, sufficient negative pressure still prevails in this area even when the rotor housing 15 is opened.

Since FIG. 3 shows a variation of the open-end spinning device of FIG. 2, only the differences to the device shown in FIG. 2 will be discussed below; the same elements and modes of operation will no longer be described separately. According to FIG. 3, it is also foreseen for the intermediate chamber 18 to be connected to a negative pressure source 23 through a third opening 22. For the pressure equalization reasons given in FIG. 2 that also occur in the negative pressure channel 16 when the rotor housing 15 is opened, the intermediate chamber 18 is also connected here to the negative pressure source 23 through its own negative pressure channel 16*a*. Naturally, and depending on the geometric conditions of the open-end spinning device 1, the intermediate chamber 18 could be connected directly to the machine-long negative pressure line 33. Compared to the open-end spinning device 1 of FIG. 2, however, the third opening 22 has been provided with a controllable shut-off device 26, so that the intermediate chamber 18 is not constantly in contact with the negative pressure source 23 but only until the lid 27 is opened. Due to the connecting openings 19 and 20 to the rotor housing 15 impinged with spinning negative pressure $P_{SU}$, however, a negative pressure sets in also in the intermediate chamber 18 and in the drive housing 17 during the spinning operation. According to the present description, a sensor 32 is provided to achieve this, either in the area of the lid 27 of the rotor housings 15 or in the area of the swivel housing 29 to register the opening of the rotor housing 15 and the shut-off device 26 opens as a result of this. The intermediate chamber 18 is therefore further impinged with a negative pressure also when the lid 27 of the rotor housing 15 is opened, thus preventing impurities from being sucked into the drive housing 17. Any deposits from the rotor housing 15 area are also transported away via the third opening 22 and the negative pressure channel 16*a* after the shut-off device 26 is opened.

Due to the fact that the intermediate chamber 18 is in any case impinged with spinning negative pressure $P_{SU}$ when the rotor housing 15 is opened, any impurities from the rotor housing 15 are sucked out through the negative pressure channel 16*a* and no longer reach the drive housing 17. The penetration of impurities into the drive housing 17 can therefore be prevented with all bearing types. However, this effect can be enhanced even more if—as in the description for FIG. 2—the axial bearing 24 is executed as axial air bearing 24*a* or the bearing comprises an air bearing. In this case, a higher air pressure $P_{AG}$ will always prevail in the drive housing 17 than the air pressure $P_{ZK}$ in the intermediate chamber 18. As a result of this, the sucking of impurities is once again prevented.

Figure 4:
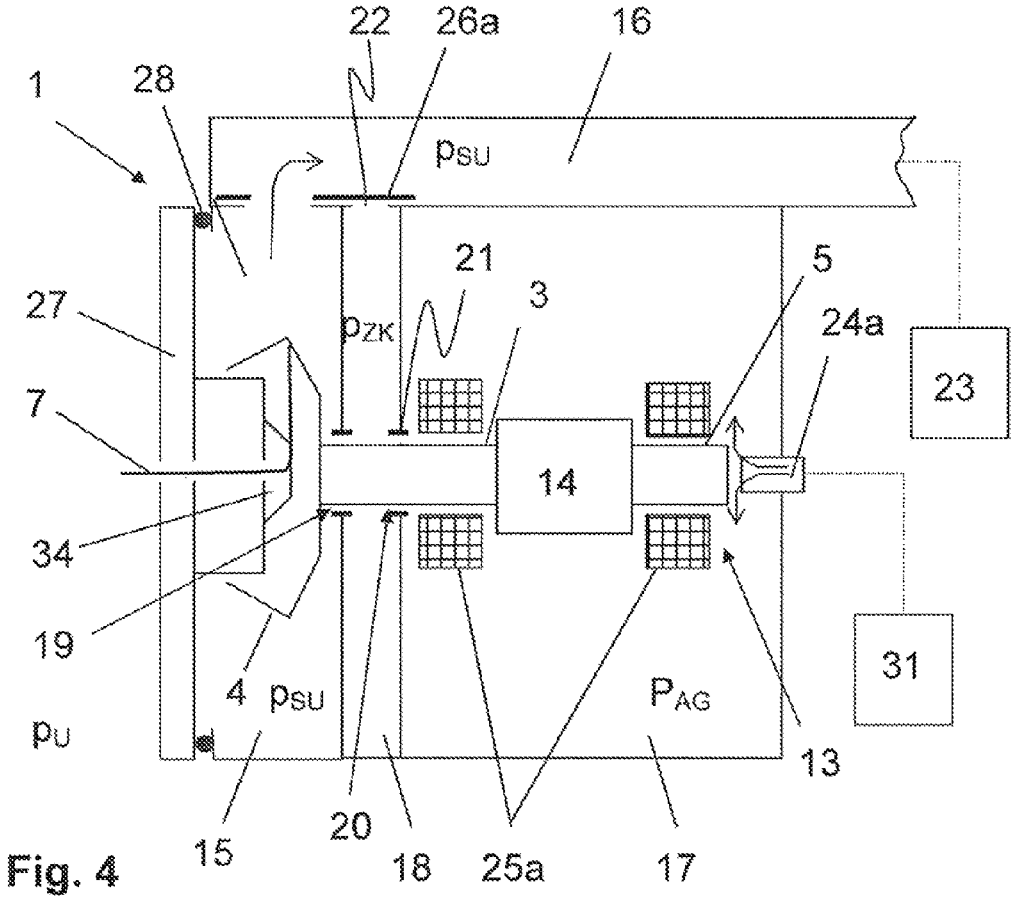
FIG. 4 a further variation of the open-end spinning device shown in FIG. 2 with an intermediate chamber impinged with negative pressure.

FIG. 4 shows another variation of the open-end spinning device 1 shown in FIG. 2 with an intermediate chamber 18 impinged with negative pressure, in which the intermediate chamber 18 is connected to the negative pressure channel 16 of the rotor housing 15 via the third opening 22. To prevent the negative effect of pressure equalization in the negative pressure channel 16 described already under FIG. 2 when the rotor housing 15 is opened, instead of providing a separate negative pressure channel 16*a*, it can also be closed against the negative pressure channel 16 when the rotor housing 15 is opened. To do this, the rotor housing 15 is provided with a shut-off device 26 that blocks or allows its connection to the negative pressure channel 16. To control the shut-off device 26, a purely mechanical coupling can be provided with the lid 27 of the rotor housing or a sensor-controlled drive, similar to what FIG. 3 shows.

Here, a slider 26*a* is provided as shut-off device 26 that connects the rotor housing 15 and the intermediate chamber 18 alternately with the negative pressure channel 16. During a regular spinning operation, the rotor housing 15 is connected to the negative pressure channel 16 to maintain the spinning negative pressure $p_{SU}$ in the rotor housing 15 in the usual way. On the other hand, the intermediate chamber 18 is closed against the negative pressure channel 16 during the regular spinning operation. Nonetheless, owing to the connective opening 19 towards the rotor housing, a negative pressure builds up in the intermediate chamber. The slider 26*a* can now be controlled in such a way that when the rotor housing 15 is opened, the connection of the rotor housing 15 to the negative pressure channel 16 is closed, while the third opening 22 is opened and the intermediate chamber 18 is now connected to the negative pressure channel 16. Thus, pressure equalization with the surrounding air pressure $P_U$ takes place only in the opened rotor housing 15, but not in the negative pressure channel 16, while the intermediate chamber 18 continues to be impinged with negative pressure through the third opening 22.

The advantage of this embodiment is that no separate negative pressure line 16*a* is necessary for the intermediate chamber 18 to maintain the negative pressure in the intermediate chamber 18, even while and after the rotor housing 15 is opened. Additionally, owing to the fact that during the spinning operation the intermediate chamber 18 is closed against the negative pressure channel 16, no air current is generated from the rotor housing 15 through the intermediate chamber 18 into the negative pressure channel 16; rather, an advantageous air current is generated from the drive housing 17 through the intermediate chamber 18 into the rotor housing 15. As a result of this, dirt deposits can largely be prevented in the intermediate chamber 18.

If full spinning negative pressure $P_{SU}$ prevails in the intermediate chamber 18 even with an opened rotor housing 15 in such a solution, then no dirt will be sucked into the drive housing 17 when the rotor housing 15 is opened; rather, impurities will be sucked out by the intermediate chamber 18 in the negative pressure channel 16. Such a solution therefore differs from the drawing shown in FIG. 4 and can be used even if no axial air bearing 24*a* is provided.

Figure 5:
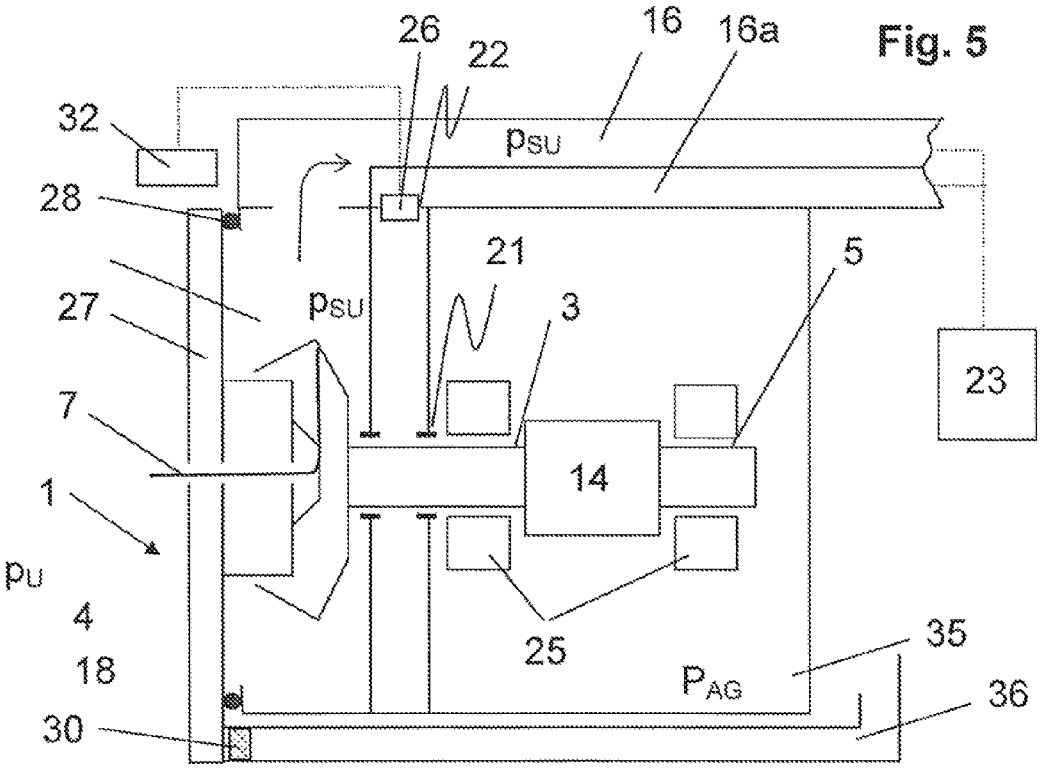
FIG. 5 another embodiment of an open-end spinning device with an intermediate chamber impinged with negative pressure and an axial bearing comprising merely an axial magnetic bearing.

Another embodiment of the open-end spinning device 1 with an intermediate chamber 18 impinged with negative pressure, usable especially for bearings without an axial air bearing 24*a*, is shown in FIG. 5. Here, the intermediate chamber 18 is connected to a negative pressure source 23 by means of an own negative pressure channel 16*a*, as described in FIG. 3. However, another alternative is also possible, namely to provide only one negative pressure channel 16 and to block off the rotor housing 15 against the negative pressure channel 16 when it is opened by means of a shut-off device 26. With regard to possible embodiments of the shut-off device 26, please refer to the explanation in FIG. 3.

Furthermore, the drive housing 17 is provided with a purge opening 35, through which the drive housing 17 can be supplied temporarily, preferably when the rotor housing 15 is opened, with dust-free purge air to flush out the impurities that could have penetrated the drive housing 17 to the intermediate chamber 18. To supply filtered surrounding air to the drive housing 17 with the surrounding air pressure $p_U$, the purge opening 35 is provided with a filter 30 or is connected to a filter 30.

According to this explanation, a purge line 36 is connected to the purge opening 35 that is, in turn, provided with a filter 30 and is closed by the lid 27 of the rotor housing 15 during the spinning operation. When the rotor housing 15 is opened, the purge line 36 is then connected to the surrounding air, so that dust-free purge air is supplied to the drive housing 17. Since purging takes place only when the rotor housing 15 is open, the purge opening 35 can be of relatively generous dimensions so fast thorough purging can be achieved.

Figure 6:
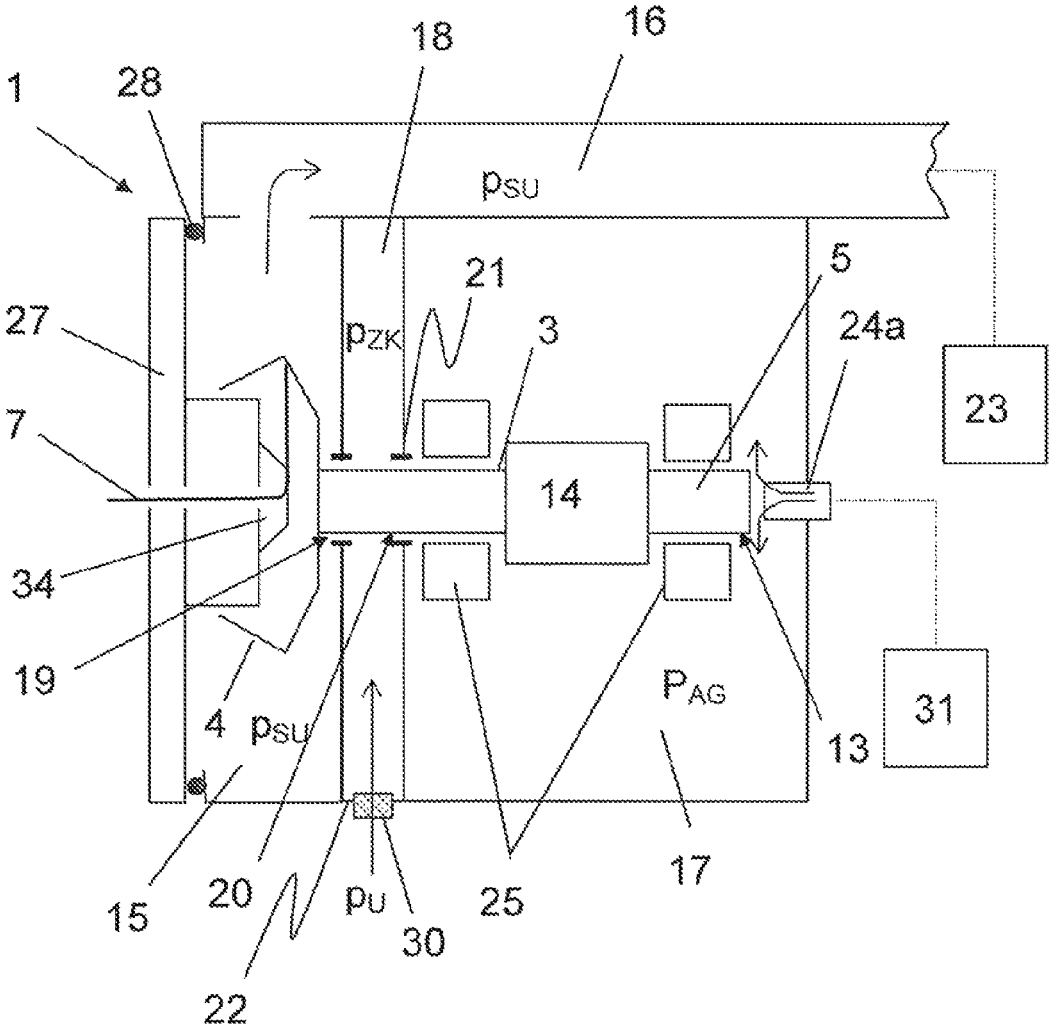
FIG. 6 an open-end spinning device with an intermediate chamber impinged with surrounding air.

A further embodiment of an open-end spinning device 1, in which the penetration of impurities into the drive housing 17 is prevented, is shown in FIG. 6. Unlike in FIGS. 2 and 3, the intermediate chamber 18 is constantly impinged with surrounding air pressure $P_U$ or is connected to it. In this spinning device 1, an air current is generated due to the intermediate chamber 18 from the third opening 22 through the first connective opening 19 into the rotor housing 15. Thus, no negative pressure occurs in the drive housing 17 even during the spinning, but depending on the bearing type used therein, either the surrounding air pressure $P_U$ too or, if an axial air bearing **24*a* is used, an increased air pressure $P_{AG}$ compared to the surrounding air pressure $P_U$. Different from the drawing shown with an axial air bearing 24*a*, it is therefore just as possible to use the spinning device 1** in connection with other bearing types.

The relationships during the regular spinning operation are shown in FIG. 6, as in FIGS. 2 and 3. Since no negative pressure builds up in the drive housing 17 during the spinning operation, air carrying the respective impurities cannot be sucked in any longer even if the rotor housing 15 is opened. To keep preventing the sucking in of impurities through the third opening 22 and the connecting opening 19 into the rotor housing 15, it is advantageous to provide the third opening 22 with an air filter 30, as shown in FIG. 6.

The invention is not restricted to the embodiments shown. Variations and combinations as part of the patent claims fall also under the invention.

LIST OF REFERENCE CHARACTERS

1 Open-end spinning device
2 Rotor spinning machine
3 Spinning rotor
4 Rotor cup
5 Rotor shaft
6 Fiber material
7 Yarn
8 Feeding device
9 Dissolving device
10 Draw-off device
11 Winding device
12 Bobbin
13 Bearing
14 Individual drive
15 Rotor housing
16 Negative pressure channel
17 Drive housing
18 Intermediate chamber
19 first connecting opening
20 second connecting opening
21 Ring seal
22 third opening
23 negative pressure source
24 Axial bearing
**24*a*** Axial air bearing
25 Radial bearing
**25*a*** Radial magnet bearing
26 Shut-off device
**26*a*** Slider
27 Lid of the rotor housing
28 Seal of the rotor housing
29 Swivel housing
30 Air filter
31 Pressurized air source
32 Sensor
33 Negative pressure line
34 Draw-off nozzle
35 Purge opening
36 Purge line
$P_U$ Surrounding air pressure
$p_{SU}$ Spinning negative pressure
$p_{AG}$ Air pressure in the drive housing
$p_{ZK}$ Air pressure in the intermediate chamber

The invention claimed is:

1. An open-end spinning device of a rotor spinning machine, comprising:

a spinning rotor having a rotor cup in which fiber material is spun;

a rotor shaft through which the spinning rotor is driven, the rotor shaft arranged in a bearing with an individual drive for driving the spinning rotor;

a rotor housing in which the rotor cup is arranged, the rotor housing impinged with spinning negative pressure (pSU) through a negative pressure channel;

a drive housing in which the rotor shaft extends and in which the drive and bearing of the spinning rotor are arranged;

the rotor housing and the drive housing spaced apart from one another in an axial direction of the rotor shaft;

an intermediate chamber enclosed by walls and arranged between the rotor housing and the drive housing, the intermediate chamber having a first connecting opening to the rotor housing and a second connecting opening to the drive housing; and the intermediate chamber having a third opening through which the intermediate chamber is connected to a negative pressure source when spinning operation of the open-end spinning device is interrupted.

2. The open-end spinning device according to claim 1, wherein the first connecting opening and the second connecting opening are defined as a ring gap within the walls around the rotor shaft or around an axially extending collar of the rotor cup.

3. The open-end spinning device according to claim 1, wherein the bearing comprises an axial bearing acting on an end of the spinning rotor facing away from the rotor cup.

4. The open-end spinning device according to claim 3, wherein the axial bearing comprises an axial air bearing.

5. The open-end spinning device according to claim 3, wherein the bearing comprises a magnetic bearing.

6. An open-end spinning device of a rotor spinning machine, comprising:

a spinning rotor having a rotor cup in which fiber material is spun;

a rotor shaft through which the spinning rotor is driven, the rotor shaft arranged in a bearing with an individual drive for driving the spinning rotor;

a rotor housing in which the rotor cup is arranged, the rotor housing impinged with spinning negative pressure (pSU) through a negative pressure channel;

a drive housing in which the rotor shaft extends and in which the drive and bearing of the spinning rotor are arranged;

the rotor housing and the drive housing spaced apart from one another in an axial direction of the rotor shaft;

an intermediate chamber arranged between the rotor housing and the drive housing, the intermediate chamber having a first connecting opening to the rotor housing and a second connecting opening to the drive housing;

the intermediate chamber having a third opening through which the intermediate chamber is connected to a negative pressure source when spinning operation of the open-end spinning device is interrupted; and wherein the intermediate chamber is connected to the negative pressure channel for the spinning negative pressure (pSU) or to an own negative pressure channel through the third opening.

7. The open-end spinning device according to claim 1, wherein at least one of the third opening or the rotor housing is configured with a controllable shut-off device that is activated by opening and closing the rotor housing.

8. The open-end spinning device according to claim 1, wherein the third opening is provided with an air filter.

9. A method to operate an open-end spinning device of a rotor spinning machine wherein the open-end spinning device includes:

a spinning rotor driven by an individual drive;

a spinning rotor arranged in a contactless way in a bearing, the spinning rotor including a rotor cup and with a rotor shaft;

the rotor cup arranged in a rotor housing impinged with spinning negative pressure (pSU) during spinning operation;

the rotor shaft extending into a drive housing in which the drive and the bearing of the spinning rotor are arranged;

wherein the method further comprises:

preventing an air current from the rotor housing to the drive housing by spacing the rotor housing and the drive housing from each other in axial direction of the rotor shaft;

enclosing an intermediate chamber with walls between the rotor housing and the drive housing;

defining a first connecting opening from the intermediate chamber to the rotor housing around the rotor shaft, and a second connecting opening from the intermediate chamber to the drive housing around the rotor shaft; and impinging the intermediate chamber with negative pressure when the spinning operation is interrupted and the rotor housing is opened such that an air current is prevented from entering the drive housing.

10. The method according to claim 9, wherein the intermediate chamber is impinged with negative pressure when the rotor housing is opened through a negative pressure channel for the spinning negative pressure (pSU) or through an own negative pressure channel.

11. The method according to claim 9, wherein the bearing of the spinning rotor comprises an axial air bearing, and further comprising controlling air flowing through the air bearing such that air pressure (pAG) in the drive housing is always greater than the air pressure (pZK) in the intermediate chamber.

12. A method to operate an open-end spinning device of a rotor spinning machine wherein the open-end spinning device includes:

a spinning rotor driven by an individual drive;

a spinning rotor arranged in a contactless way in a bearing, the spinning rotor including a rotor cup and with a rotor shaft;

the rotor cup arranged in a rotor housing impinged with spinning negative pressure (pSU) during spinning operation;

the rotor shaft extending into a drive housing in which the drive and the bearing of the spinning rotor are arranged;

wherein the method further comprises:

preventing an air current from the rotor housing to the drive housing by spacing the rotor housing and the drive housing from each other in axial direction of the rotor shaft;

arranging an intermediate chamber between the rotor housing and the drive housing;

defining a first connecting opening from the intermediate chamber to the rotor housing around the rotor shaft, and a second connecting opening from the intermediate chamber to the drive housing around the rotor shaft;

impinging the intermediate chamber with negative pressure when the spinning operation is interrupted and the rotor housing is opened such that an air current is prevented from entering the drive; and wherein the intermediate chamber is impinged with spinning negative pressure (pSU) through the negative pressure channel of the open-end spinning device or through an own negative pressure channel.

* * * * *